United States Patent [19]

White

[11] Patent Number: 4,592,446

[45] Date of Patent: Jun. 3, 1986

[54] PORTABLE TELESCOPING TREE STAND

[76] Inventor: Harry B. White, 1656 Longspur Ct., Naperville, Ill. 60565

[21] Appl. No.: 667,874

[22] Filed: Nov. 2, 1984

[51] Int. Cl.[4] ..... E06C 1/12

[52] U.S. Cl. ..... 182/93; 182/100; 182/116; 182/189; 182/195

[58] Field of Search ..... 182/100, 189, 156, 92, 182/228, 151, 178, 195

[56] References Cited

U.S. PATENT DOCUMENTS

| | | | |
|---|---|---|---|
| 494,358 | 3/1893 | Weeks | 182/151 |
| 2,815,130 | 12/1957 | Franks | 182/178 |
| 3,026,962 | 3/1962 | Kramer | 182/189 |
| 3,729,063 | 4/1973 | Hein | 182/189 |
| 4,230,203 | 10/1980 | Sweat | 182/187 |
| 4,257,490 | 3/1981 | Bandy | 182/187 |
| 4,263,983 | 4/1981 | Norton | 182/100 |
| 4,411,335 | 10/1983 | Forrester | 182/187 |

FOREIGN PATENT DOCUMENTS

| | | | |
|---|---|---|---|
| 2650005 | 5/1978 | Fed. Rep. of Germany | 182/189 |

*Primary Examiner*—Reinaldo P. Machado
*Attorney, Agent, or Firm*—Emrich & Dithmar

[57] ABSTRACT

A portable telescoping observation stand attachable to a pole, a tree or like object by way of straps includes a plurality of telescopically engaged sections maintained in an extended position by locking members removably received in slots in overlapping ends of adjacent sections. Foot hold members removably attached to the sections provide steps for the stand with the locking members also serving as steps for the stand. When the stand is collapsed, the sections are nested together, the removed locking members and foot hold members are stored in a compartment defined by the nested sections.

13 Claims, 11 Drawing Figures

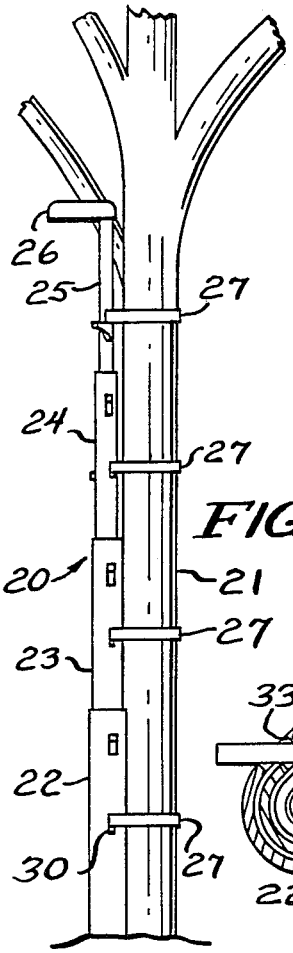
FIG. 1
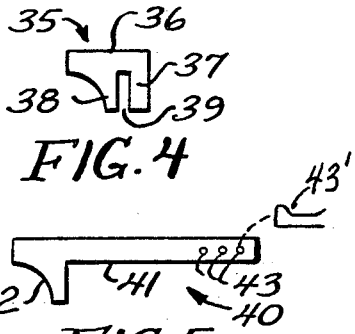
FIG. 4
FIG. 5
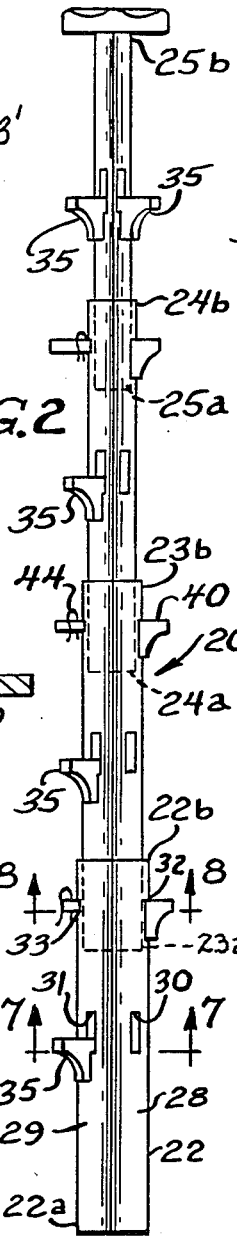
FIG. 2
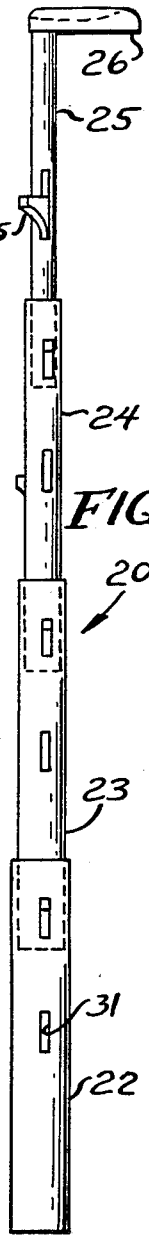
FIG. 3
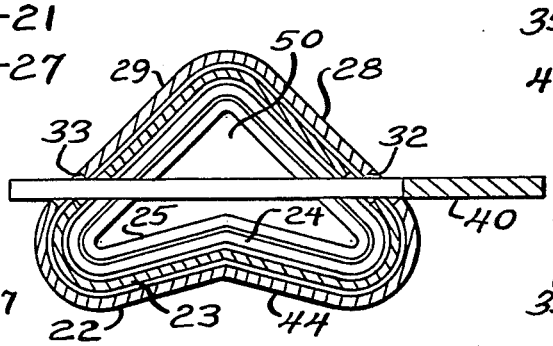
FIG. 8
FIG. 6
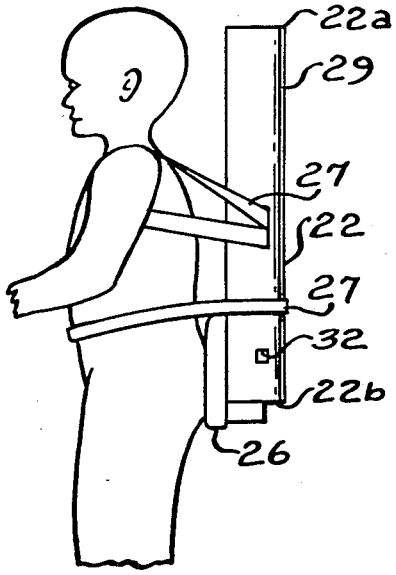
FIG. 7
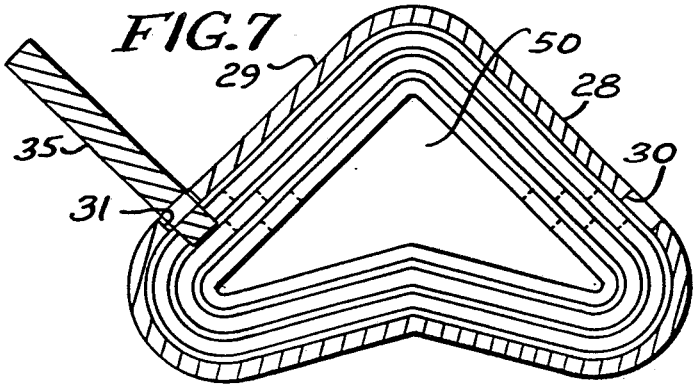

PORTABLE TELESCOPING TREE STAND

BACKGROUND OF THE INVENTION

This invention relates to portable observation stands and particularly observation stands attachable to a pole, tree or like object.

Various designs for portable observation stands have been disclosed by the prior art. For example, in U.S. Pat. No. 4,230,203 issued to George B. Sweat et al, there is disclosed a tree climbing apparatus including upper and lower support members each in the form of an open frame adapted to encircle the tree trunk with inwardly projecting blades on forward and rearward edges engaging the tree trunk. The user sits on the upper support member and has his feet secured to the lower support member and ascends a tree by alternately disengaging and reengaging the blades of the upper support member and then the lower support member, repositioning the upper or lower support member upwardly when its blades are disengaged from the tree trunk. The use of this apparatus requires coordination and strength to properly reposition the upper and lower supports during a tree climbing operation. Moreover, because the upper and lower support members encircle the tree trunk, the tree climbing apparatus is limited for use with trees having a diameter sufficiently small to permit emplacement of the two support members and the user may not ascend above the height of the first limb. A further shortcoming of this apparatus is that its component parts must be assembled together with fasteners before use, a time consuming and tedious task.

Other arrangements disclosed by the prior art include use of a multi-section pole having foot holds welded to individual metal sections. A flexible line or strap is used for attaching the pole to the object being scaled. One such arrangement shown in U.S. Pat. No. 4,257,490 issued to Irvin C. Bandy includes a plurality of tubular sections pivotally interconnected. Another arrangement in U.S. Pat. No. 4,263,983, issued to Don S. Norton, includes a plurality of angle metal sections which are removably interconnected using male/female connectors at either end thereof. Typically four or more sections each about four feet long are used. Although these multi-section scaling poles are relatively easy to erect, they do not provide a compact package for carrying purposes, because the sections, whether collapsed upon one another as in the Bandy arrangement, or disconnected as in the Norton arrangement, must be carried in side-by-side relation with the foot holds projecting outwardly in both directions from each section.

SUMMARY OF THE INVENTION

The present invention provides a portable telescoping observation stand for attachment to a pole, a tree or like object and which is not only easy to erect, but also presents a compact package for carrying purposes. Moreover, the component parts of the observation stand are of simple configurations and thus easily manufactured.

In accordance with the invention, an observation stand comprises a multi-section, pole-like assembly including a base section and at least one extension section, each section including a hollow elongated member having first and second ends, the sections having different cross-sectional areas to permit the sections to be assembled together coaxially aligned, one within another, in telescopic engagement, each inner section of the assembly being movable relative to the outermost section of the assembly along a longitudinal axis between a nested position, in which each inner section is substantially contained within the outermost section defining a collapsed configuration for the stand, and an extended position in which a major portion of each inner section extends beyond an adjacent section, defining an extended configuration for the stand; locking means for releaseably locking said sections in their extended position; a plurality of foot hold members each removably attachable to a different one of the sections; and securing means for releasably attaching the stand to the object. The stand may include seating means carried by the topmost section of the stand.

In accordance with a feature of the invention, the locking means includes one or more apertures in the base section near one end and one or more locking members which extend through the apertures and engage the adjacent extension section at an end thereof which overlaps the apertured end of the base section. The foot hold members may be received in longitudinal slots provided in each of the sections.

In accordance with another feature of the invention the sections define a longitudinally extending storage compartment for the locking members and the foot hold members when the stand is in its collapsed configuration, and the securing means, in the form of straps which attach the stand to the object, may also be used to strap the collapsed stand to the back of a user for transporting the stand.

Other objects and features of the present invention will be apparent from the following description and claims and are illustrated in the accompanying drawing which, by way of illustration, shows preferred embodiments of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

FIG. 1 a side elevation view of an observation stand of the present invention shown attached to a tree;

FIG. 2 is a front elevation view of the observation stand;

FIG. 3 is a side elevation view of the observation stand;

FIG. 4 is a side elevation view of a step member of the observation stand;

FIG. 5 is a side elevation view of an anchor member of the observation stand;

FIG. 6 is a side perspective view illustrating the observation stand in its collapsed condition being carried on the back of a person;

FIGS. 7 and 8 are enlarged sectional views taken along respective lines 7—7 and 8—8 of FIG. 2;

DESCRIPTION OF THE PREFERRED EMBODIMENTS

Figure 9:
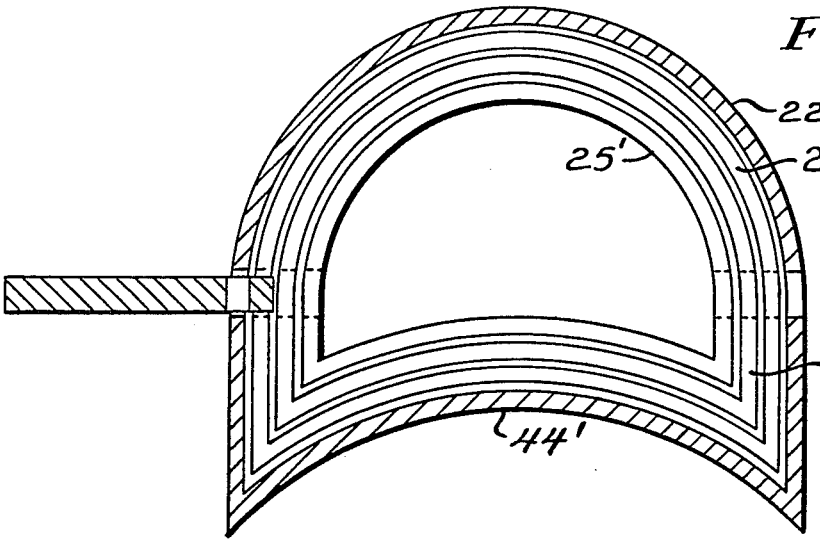
FIG. 9 is a cross-sectional view, similar to FIG. 7, of an alternate embodiment of an observation stand provided by the present invention.
Figure 10:
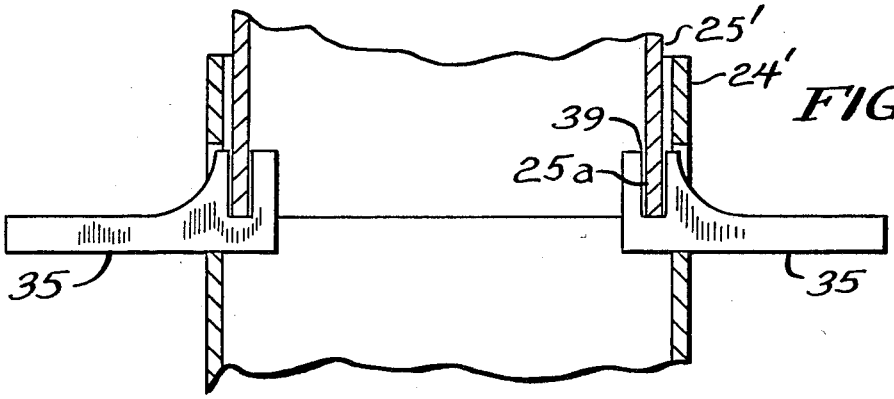
FIG. 10 is a fragmentary front elevation view, partially in section, illustrating an alternate manner for interlooking sections of the observation stand.

Referring to FIG. 1, the portable telescoping observation stand 20 provided by the present invention is illustrated as being attached to a tree 21. The observation stand 20 includes a base section 22 and a plurality of extension sections 23–25 which extend upwardly from the base section 22, locating a seat 26 adjacent to the lower limbs of the tree 21. The sections 22–25 are secured to the tree 21 by way of straps 27.

Referring to FIGS. 2 and 3, sections 22–25 have lower ends 22*a*–25*a*, respectively, and upper ends 22*b*–25*b*, respectively. Each of the sections 22–25, such as the base section 22 has forward surfaces 28 and 29 provided with a pair of respective slots 30 and 31 aligned one with the other and extending longitudinally of the member 22 near the center portion thereof. Each of the sections 22–24, such as section 22 also includes a pair of apertures 32 and 33 in surfaces 28 and 29, respectively, shown best in FIG. 8, which are located near the upper end 22*b* of the member 22 and aligned in diametrically opposed relation. As shown in FIG. 6, the apertures 32 and 33 are rectangular in shape.

Referring to FIG. 2–5, the stand 20 includes a plurality of removable foot hold members 35, including a foot hold member 35 for each of the sections 22–24 and two foot hold members 35 in the top most section 25. Each step member 35 (FIG. 4) has a generally rectangular upper portion 36 defining a step surface, and two downwardly projecting spaced apart mounting portions 37, 38 defining a slot 39.

The stand 20 further includes a plurality of removable anchor or locking members 40, including a locking member 40 for each adjacent pair of the sections 22–25. Each locking member 40 (FIG. 5) is generally L-shaped with a horizontal shank portion 41 and a downwardly projecting bearing portion 42. The shank 41 has a plurality of apertures 43.

The sections 22–25, as well as the seat 26, step members 35 and locking members 40, are of a rigid, light weight material, such as aluminum, plastic, glass reinforced plastic, or the like. The sections 22–25 have a generally triangular cross-section, FIG. 8, and are reduced in cross-sectional areas from the outer base section 22 to the inner or top section 25. The triangular cross-section defines the forward surfaces 28 and 29 which extend generally normal to one another. The rearward surfaces of the sections, such as surface 44 of base section 22, are concave to conform generally to the curved surface of the tree to which the stand 20 is attached.

The reduced cross-sectional areas permit the sections 22–25 to be nested one within the other, defining a collapsed configuration for the stand 20. The inner sections 25, 24, 23 are slidable along the inner surface of respective adjacent sections 24, 23 and 22 to an extended position (FIGS. 2 and 3) in which the upper edge 22*b* of base section 22 overlies the lower edge 23*a* of section 23, the upper edge 23*b* of section 23 overlies the lower edge 24*a* of the section 24, etc.

Referring to FIGS. 1–3, the sections 22–25 are maintained in the extended position by the locking members 40 which have their shank portion extending through the aligned apertures 32 and 33 and are locked, in place with a suitable means such as a cotter pin 43′ which is received in one of the apertures 43 of locking member 40. Three apertures 43 are provided because of the reduced width of the upper sections relative to the base section 22. The locking members 40 also serve as a step or foot hold for the stand 20 supplementing the step members 35 which are received in one of the slots 30 of 31, such as slot 31 in each of the sections 22–24. An additional foot hold 35 is received in slot 30 of the top most section 25 near the seat 26, the two foot holds serving as foot rests for the user. The seat 26 is pivotally mounted on the topmost section 25.

The telescoping configuration of the sections 22–25 enables the extension sections 23–25 to be nested within the base section 22, as illustrated in FIG. 6, providing a compact package which is easily carried from one location to another. The hollow center of the inner most section 25 defines a storage compartment 50, the bottom of which is closed by the seat 26, for the foot hold members 35 and the locking members 40. In FIG. 6, the stand 20 is shown in its collapsed condition with sections 22–25 nested one within the other and being carried, upside down, i.e. with bottom edges 22*a*–25*a* at the top, on the back of a person, and secured thereto by two of the straps 27 which are provided with suitable VELCRO type fasteners or the like. One of the straps passes through slots 30, 31 of the nested sections and encircles the shoulder of the person. Another strap encircles the waist of the person and the collapsed stand 20. The seat 26 may be pivoted to extend parallel to section 22 as illustrated.

To erect the observation stand 20, the user removes the locking members 40 and foot holds 35 from the storage compartment 50 by turning the collapsed observation stand 20 right side up to allow the foot holds and locking members to fall to the ground. The sections 23, 24 and 25 are extended relative to one another and to the base section 22 until edges of adjacent sections overlap with the apertures 32, 33 at the top edges 22*b*–24*b* of sections 22, 23 and 24 aligned with the corresponding apertures 32, 33 in the bottom edges 23*a*–25*a* of sections 23, 24 and 25, respectively.

To interconnect sections 22 and 23, the shank 41 of a locking member 40 is threaded through the aligned apertures 32 and 33 of sections 22 and 23 and its end is held in place by cotter pin 43′. Similarly, additional locking members 40 are used to lock together the overlapping ends of sections 23 and 24 and sections 24 and 25. Since in this case the locking members 40 provide foot holds on the forward edge 28, the right side as viewed in FIG. 2, foot hold members 35 are placed in the slot 31 in the left-hand forward surface 29 of each of the sections 22–25. An additional foot hold member 35 is placed in the slot 30 of the upper most section 25 just beneath the seat 26 to provide foot rests for the user. The straps 27 are then threaded through slots 30, 31 of each section.

The observation stand 20 thus extended with its sections locked together and its securing straps in place, is then positioned parallel to the trunk of the tree 21 to be scaled as shown in FIG. 1. The base section 22 as well as the next section 23 can be secured to the tree trunk by straps 27 while the user is standing on the ground. The remaining straps 27 which secure the higher up section 24 and the top section 25 to the tree trunk are fastened together by the user as he ascends the stand 20.

Figure 11:
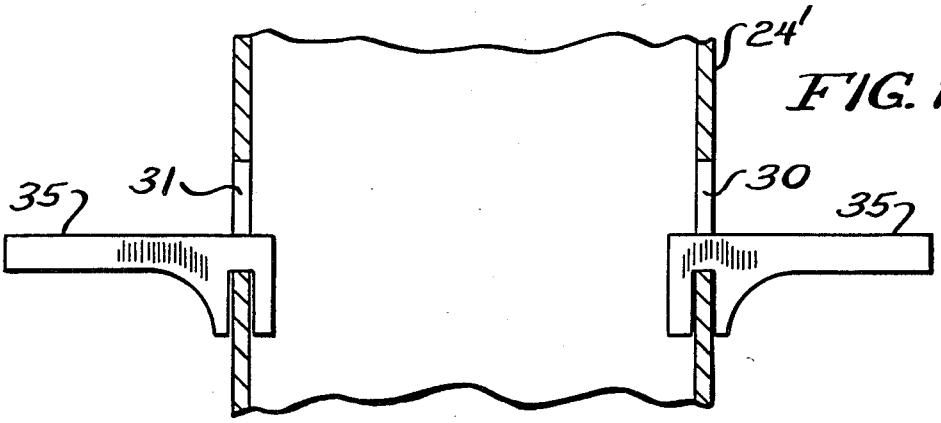
FIG. 11 is a fragmentary view, partially in section illustrating the manner in which step members are attached to a section of the observation stand.

Referring to FIG. 9, in an alternate embodiment, and observation stand has sections 22′–25′ which have a generally semi-circular cross-section and the rearwardly extending edges, such as edge 44' of the outer member 22', which engage the tree are of a concave arcuate configuration. In this embodiment, a foot hold member, such as foot hold member 35 (FIG. 4) is used as a locking member as well as for foot holds. When used as the locking member, shown in FIG. 9, member 35 is inverted and has its slotted end directed upwardly to receive the lower edge 25*a* of the adjacent inner section 25'. Two members 35 are used to interconnect each pair of adjacent sections. As shown in FIG. 11, a pair of foot hold members 35 are used in each of the four sets of slots 30, 31 along the extent of the observation stand in the manner illustrated in the embodiment shown in FIGS. 2 and 3.

I claim:

1. A portable telescoping observation stand for attachment to a pole, a tree or like object comprising:

a multi-section, pole-like assembly including a base section and at least one extension section, each section including a hollow elongated member having first and second ends, said sections having different cross-sectional areas to permit said sections to be assembled together coaxially aligned, one within another, in telescopic engagement, each inner section of the assembly being movable relative to the outermost section of the assembly along a longitudinal axis between a nested position, in which each inner section is substantially contained within said outermost section defining a collapsed configuration for the stand, and an extended position in which a major portion of each inner section extends beyond an adjacent section, defining a extended configuration for the stand and wherein each of said sections has a concave outer surface which is drawn into engagement with the surface of the object along at least first and second lines of contact to substantially eliminate rotation of the stand about its vertical axis;

locking means for releasably locking adjacent sections together in their extended position;

a plurality of foot hold members each removably attachable to a different one of said sections;

securing means for releasably attaching the stand to the object; and seating means carried by the upper extension section.

2. An observation stand according to claim 1, wherein said locking means includes a plurality of locking members, each defining a further foot hold member for the stand.

3. An observation stand according to claim 1, wherein the first end of said base section overlaps the second end of an adjacent extension section when it is at its extended position, said locking means including at least one aperture in said base section adjacent to its first end, and a locking member which extends through said aperture and engages the adjacent extension section near its second end.

4. An observation stand according to claim 3, wherein said base section has a first pair of aligned apertures near its first end and said adjacent extension section has a second pair of apertures near its second end and aligned with corresponding apertures of said first pair when said extension section is in its extended position, and said locking member having an elongated shank portion which passes through both apertures of said first and second pairs.

5. An observation stand according to claim 3, wherein said locking means comprises first and second diametrically opposed apertures in said base section and first and second locking members, one extending through each aperture and defining a slot at one end thereof which receives an edge of said adjacent extension section at its second end.

6. An observation stand according to claim 1, wherein each section has at least one longitudinally extending slot, each foot hold member defining a step portion extending transversely of the section and a mounting portion received in said slot and having a slot extending normal to its step portion and straddling the section adjacent thereto.

7. An observation stand according to claim 1, wherein certain ones of said sections have a pair of longitudinally extending slots for receiving said foot hold members, said securing means including a belt for each of said certain sections extending through the slots thereof and around the object, and having fastening means for connecting together first and second ends of said belt.

8. An observation stand according to claim 3, wherein said sections define a longitudinally extending storage compartment for receiving said foot hold members, and said locking members when the stand is in its collapsed configuration.

9. An observation stand according to claim 1, wherein said concave outer surface is generally V-shaped.

10. An observation stand according to claim 1, wherein said concave outer surface is generally arcuate.

11. A portable telescoping observation stand for attachment to a pole, a tree or like object comprising:

a multi-section, pole-like assembly including a base section and at least one extension section, each section including a hollow elongated member having first and second ends, certain of said sections including said base section having at least one aperture adjacent to its first end with said sections having an outer concave surface for engaging the surface of the object, said sections having different cross-sectional areas to permit said sections to be assembled together, coaxially aligned, one within another, in telescopic engagement, each inner section of the assembly being movable relative to the outermost section of the assembly along a longitudinal axis between a nested position, in which each inner section is substantially contained within said outermost section, defining a collapsed configuration for the stand, and an extended position in which a major portion of each inner section extends beyond an adjacent section with its second end overlapping the first end of an adjacent section, defining an extended configuration for the stand;

locking means for releasably locking adjacent sections together to maintain the sections in their extended position, said locking means including an individual locking member for each pair of adjacent sections constructed and arranged to extend through said aperture in the first end of one section of the pair and engage the other section of the pair at its second end;

a plurality of foot hold members each removably attachable to a different one of said sections;

securing means for releasably attaching the stand to the object; and seating means carried by the upper extension section.

12. An observation stand according to claim 11, wherein said base section has a first pair of aligned apertures near its first end and said adjacent extension section has a second pair of apertures near its second end and aligned with corresponding apertures of said first pair when said extension section is in its extended position, and said locking member having an elongated shank portion which passes through both apertures of said first and second pairs.

13. An observation stand according to claim 11, wherein said locking means comprises first and second diametrically opposed apertures in said base section and first and second locking members, one extending through each aperture and defining a slot at one end thereof which receives an edge of said adjacent extension section at its second end.

* * * * *